US009885456B2

(12) United States Patent
Yano

(10) Patent No.: US 9,885,456 B2
(45) Date of Patent: Feb. 6, 2018

(54) VENTILATION DEVICE AND VEHICULAR LAMP

(71) Applicant: NITTO DENKO CORPORATION, Ibaraki-shi, Osaka (JP)

(72) Inventor: Youzou Yano, Ibaraki (JP)

(73) Assignee: NITTO DENKO CORPORATION, Ibaraki-shi (JP)

( * ) Notice: Subject to any disclaimer, the term of this patent is extended or adjusted under 35 U.S.C. 154(b) by 0 days.

(21) Appl. No.: 15/306,317

(22) PCT Filed: Dec. 25, 2014

(86) PCT No.: PCT/JP2014/084257
§ 371 (c)(1),
(2) Date: Oct. 24, 2016

(87) PCT Pub. No.: WO2015/163829
PCT Pub. Date: Oct. 29, 2015

(65) Prior Publication Data

US 2017/0045195 A1 Feb. 16, 2017

(30) Foreign Application Priority Data

Apr. 23, 2014 (JP) ..... 2014-089227

(51) Int. Cl.
*F21S 8/10* (2006.01)
*F21V 31/03* (2006.01)

(52) U.S. Cl.
CPC ..... *F21S 48/332* (2013.01); *F21S 8/10* (2013.01); *F21S 48/31* (2013.01); *F21V 31/03* (2013.01);
(Continued)

(58) Field of Classification Search
CPC ..... A61K 31/7048; A61K 31/513; A61K 31/496; A61K 31/4418; A61K 31/4196;
(Continued)

(56) References Cited

U.S. PATENT DOCUMENTS 5,842,776 A 12/1998 Shigemura et al.
6,210,014 B1 4/2001 Kubizne et al.
(Continued)

FOREIGN PATENT DOCUMENTS

EP 1363484 A2 11/2003
EP 2306084 A2 4/2011
(Continued)

OTHER PUBLICATIONS

Feb. 10, 2015 International Search Report issued in International Patent Application No. PCT/JP2014/084257.
(Continued)

*Primary Examiner* — Tracie Y Green
(74) *Attorney, Agent, or Firm* — Oliff PLC

(57) ABSTRACT

Disclosed is a ventilation device for discharging water vapor from the interior of a housing of a vehicular lamp to the outside of the housing, wherein: a ventilation path that is bent and is in communication with a ventilation opening in the housing is formed; and, up to the terminal end of the ventilation path including the bent part, the ventilation path maintains a minimum cross-sectional area with which it is possible to maintain a fogging reduction rate of 80% or higher in a lapse of 5 minutes. Thus, a defogging property inside the housing is improved while preventing the infiltration of liquid water and external substances by employing the ventilation path having a bent part.

6 Claims, 6 Drawing Sheets

(52) U.S. Cl.
CPC ..... *F21S 48/1225* (2013.01); *F21S 48/13* (2013.01); *F21S 48/22* (2013.01); *F21S 48/23* (2013.01)

(58) Field of Classification Search
CPC .. A61K 31/343; A61K 31/201; A61K 31/137; A01N 63/04; C07K 14/415
See application file for complete search history.

(56) References Cited

U.S. PATENT DOCUMENTS

| | | | |
|---|---|---|---|
| 2003/0216119 | A1 | 11/2003 | Mashiko et al. |
| 2010/0227544 | A1 | 9/2010 | Furuyama et al. |

FOREIGN PATENT DOCUMENTS

| | | | |
|---|---|---|---|
| JP | S60-84003 | U | 6/1985 |
| JP | H04-2409 | U | 1/1992 |
| JP | H06-7522 | Y2 | 2/1994 |
| JP | 2003-336874 | A | 11/2003 |
| JP | 2007-186189 | A | 7/2007 |
| JP | 4276246 | B2 | 6/2009 |

OTHER PUBLICATIONS

Oct. 25, 2017 Office Action issued in Korean Patent Application No. 10-2016-7029076.
Dec. 6, 2017 Search Report issued in European Patent Application No. 14889884.4.

IIC - IIC

IID - IID

IIIB - IIIB

IVB - IVB

IVC - IVC

VENTILATION DEVICE AND VEHICULAR LAMP

TECHNICAL FIELD

The present invention relates to a ventilation device forming a ventilation path and a vehicular lamp.

BACKGROUND ART

For example, in Patent Document 1, a ventilation opening larger than 132 $mm^2$ is covered with a ventilation unit for reducing condensation provided with at least one water vapor permeable material having an expanded PTFE membrane. It is described that, accordingly, elimination of condensed substances from the vehicular lamp is facilitated, to thereby provide protection not to allow external substances or liquid water to infiltrate.

CITATION LIST

Patent Literature

Patent Document 1: Japanese Patent No. 4276246

SUMMARY OF INVENTION

Technical Problem

An object of the present invention is to improve a defogging property in a housing interior while suppressing infiltration of external substances and liquid water by use of a ventilation path including a bent part.

Solution to Problem

Under such an object, the present invention provides a ventilation device (10, 30, 50, 70) for discharging water vapor in an interior (8) of a housing (2) of a vehicular lamp (1) to an outside of the housing, the ventilation device including: a ventilation path support body that forms a ventilation path (20, 40, 60, 80) that is bent and is in communication with a ventilation opening (9) in the housing, the ventilation path support body being configured to allow the ventilation path to maintain, up to a terminal end of the ventilation path including a bent part, a minimum cross-sectional area capable of maintaining a fogging reduction rate of 80% or more in a lapse of 5 minutes.

Here, the minimum cross-sectional area of the ventilation path (20, 40, 60, 80) is at least 300 $mm^2$ or more, and the minimum cross-sectional area of 300 $mm^2$ or more is maintained up to the terminal end.

Moreover, the ventilation path (20, 40, 60) of the ventilation path support body has the bent part bending from a first direction (P) to a second direction (Q), and a protruding amount toward the first direction at the bent part is smaller than an opening width of the ventilation opening while maintaining the sum of the cross-sectional area of the ventilation path of 300 $mm^2$ or more.

From another standpoint, the present invention is a ventilation device (10, 30, 50, 70) for discharging water vapor in an interior (8) of a housing of a vehicular lamp (1) to an outside of the housing, the ventilation device including: a ventilation path support body that forms a ventilation path (20, 40, 60, 80) that is bent and is in communication with a ventilation opening (9) in the housing (2), the ventilation path support body being configured to allow the ventilation path to maintain, up to a terminal end of the ventilation path including a bent part, a minimum cross-sectional area of at least 300 $mm^2$ or more.

Here, the ventilation path (80) of the ventilation path support body includes a branch part from which plural ventilation paths are branched off, and a sum of minimum cross-sectional areas of the plural paths after branching is 300 $mm^2$ or more, the ventilation path being configured to maintain the sum of the minimum cross-sectional areas of 300 $mm^2$ or more from the branch part up to the terminal end of the ventilation path.

Further, a vehicular lamp (1), to which the present invention is applied, includes: an electrical component (4) that emits light; a housing (2) that forms a space inside thereof including the electrical component; a ventilation opening (9) provided to the housing to discharge water vapor in an interior (8) of the housing; and a ventilation path support body (10, 30, 50, 70) that forms a ventilation path (20, 40, 60, 80) that is bent and is in communication with the ventilation opening in the housing, wherein the ventilation path of the ventilation path support body is configured to maintain, up to a terminal end of the ventilation path including a bent part, a minimum cross-sectional area capable of maintaining a fogging reduction rate of 80% or more in a lapse of 5 minutes, or is configured to maintain, up to the terminal end of the ventilation path including the bent part, a minimum cross-sectional area of at least 300 $mm^2$ or more.

Note that the above signs in this section are provided for exemplification in describing the present invention, and the present invention is not subjected to limited interpretation by these signs.

Advantageous Effects of Invention

According to the present invention, it is possible to improve the defogging property in the housing interior while suppressing infiltration of the external substances and the liquid water by use of the ventilation path having the bent part.

DESCRIPTION OF EMBODIMENTS

Hereinafter, exemplary embodiments according to the present invention will be described in detail with reference to attached drawings.

[Overall Configuration of Vehicular Lamp]

Figure 1:
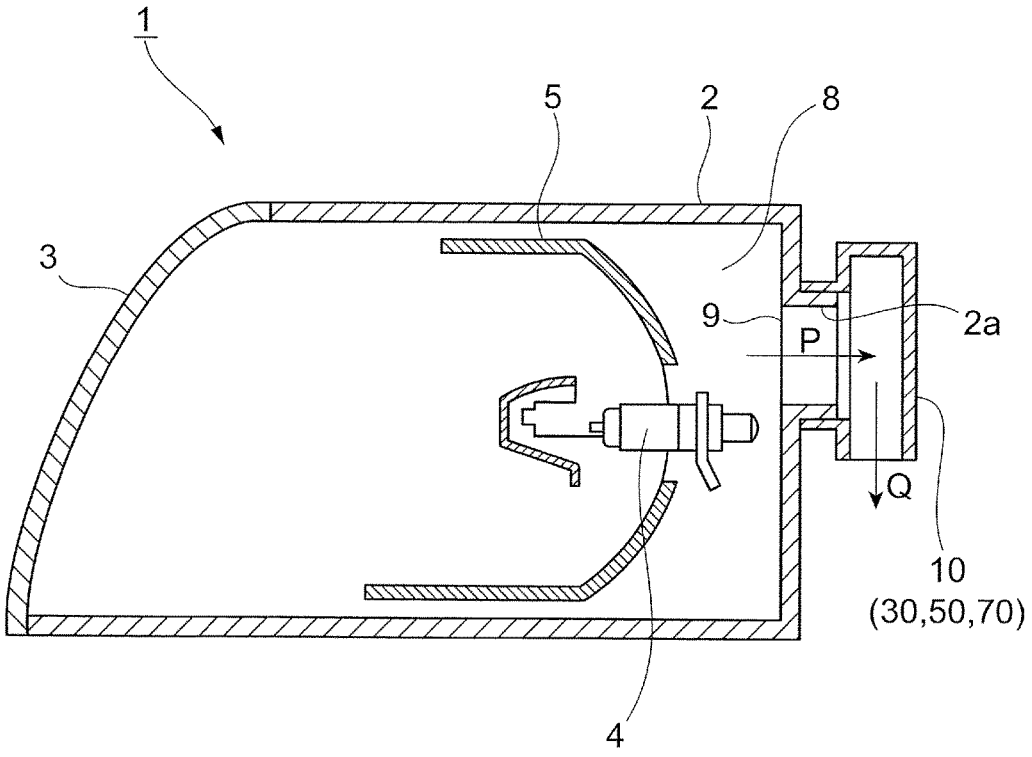
FIG. 1 is a diagram showing an overall configuration of a vehicular lamp to which exemplary embodiments are applied.

FIG. 1 is a diagram showing an overall configuration of a vehicular lamp 1 to which the exemplary embodiments are applied.

The vehicular lamp 1 to which the exemplary embodiments are applied is used as a head lamp, a rear lamp, a brake lamp, a fog lamp, a direction indicator lamp, a taxing lamp, a parking lamp, etc., of various kinds of vehicles typified by, for example, automobiles. FIG. 1 shows a specific example of these lamps.

The vehicular lamp 1 shown in FIG. 1 includes a housing 2 that protects electrical components of the vehicle and a lens 3 that is attached to the housing 2 to emit light at a proper angle, in such a manner to concentrate light toward the front of the lamp. By the housing 2 and the lens 3, a closed housing interior 8 of the vehicular lamp 1 is configured, and thereby a waterproofing property or a dust-proofing property for each electrical component in the housing interior 8 is improved. However, the housing interior 8 is not in an absolute sealed state; ventilation is possible via a ventilation opening 9. The housing interior 8 is provided with, as one of the electrical components, a bulb 4 that emits light and a reflector 5 that reflects light emitted from the bulb 4 in the lateral direction or rear direction toward the front.

Moreover, in the exemplary embodiments, the vehicular lamp 1 includes, as one of an aeration unit, a ventilation member 10 that performs transfer of air between interior and exterior of the lamp, and in particular, that is able to quickly discharge water vapor in the housing interior 8 to the exterior of the vehicular lamp 1. The ventilation member 10 is in communication with the ventilation opening 9 and forms a bending ventilation path, to thereby function as a ventilation path support body that supports the ventilation path. Then, the vehicular lamp 1 provided with the ventilation member 10 can be grasped as a mode of a ventilation device. Around the ventilation opening 9 in the housing 2, a protruding part 2*a* for attaching the ventilation member 10 is formed. By fitting the ventilation member 10 over the protruding part 2*a*, the ventilation member 10 can be attached to the housing 2.

The P-direction shown in FIG. 1 is a depth direction, which is on an engine room side when the vehicular lamp 1 is used as the head lamp or the fog lamp, or is on a trunk side when the vehicular lamp 1 is used as the rear lamp. If a protruding amount of the ventilation member 10 in the P-direction becomes large, the ventilation member 10 is apt to constitute an obstacle to functional components or the like on the depth side. The water vapor in the housing interior 8, in the ventilation path, first, heads for a first direction (P-direction) from the ventilation opening 9. Thereafter, the water vapor is bent at the bent part within the ventilation member 10, and heads for a second direction (Q-direction) from top to bottom in the figure.

In general, an automobile lamp is provided with, as a function of discharging water vapor within the lamp to the outside and a function of canceling pressure difference caused by temperature change, a hole on a lamp housing side, and a ventilation member for dust-proofing and waterproofing is attached to the hole. Compatibility between the function of canceling the pressure difference and the dust-proofing and waterproofing property can be handled by a ventilation member, such as a PTFE (polytetrafluoroethylene) film. However, for the water vapor once infiltrated into the inside of the lamp, it is difficult to be discharged to the outside due to a complicated structure inside the lamp, to thereby cause a problem of condensation inside the lens surface by the temperature change. Moreover, if xenon or halogen is used for the lamp, it is possible to eliminate condensation by heat in lighting; however, for example, when an LED lamp is used, an amount of heat inside the lamp is decreased, and therefore, it becomes difficult to eliminate condensation by heat. Further, in a so-called hybrid vehicle or electric vehicle, electrical components are increased from a safety and environmental standpoint and converge into an engine room, and accordingly, there is a tendency of a shortage of space on the lamp housing side.

Here, in a ventilation device disclosed in Patent Document 1 (Japanese Patent No. 4276246), a sum of ventilation opening areas is 132 $mm^2$ or more, and thereby, a certain functional role in water vapor permeability for eliminating condensation is fulfilled. However, if a PTFE film as the ventilation member is placed at an opening part as in the document for ensuring dust-proofing and waterproofing property, there occurs inferior permeability as compared to a through hole without ventilation material; therefore, it is impossible to respond high demands of defogging property in recent years by an opening of the order of 132 $mm^2$ shown in the document. Moreover, it is possible to make a ventilation device thinner by placing the ventilation member separately at the opening part; however, if the ventilation member is directly protruded to the outside, there is a possibility that the ventilation member is broken by water pressure, collision of a flying stone or the like.

Therefore, in the exemplary embodiments, there is provided a ventilation device capable of discharging water vapor in the housing interior 8 to the outside of the lamp even if a lamp with a low amount of heat, such as an LED, as well as the lamp using xenon or halogen, is used. In other words, the ventilation device is configured such that a ventilation path that is bent and is in communication with the ventilation opening 9 in the housing is formed, and, up to the terminal end of the ventilation path including the bent part, the ventilation path maintains a minimum cross-sectional area capable of maintaining a fogging reduction rate of 80% or higher in a lapse of 5 minutes. Moreover, the ventilation device is configured such that the bent ventilation path maintains a minimum cross-sectional area of at least 300 $mm^2$ or more to the terminal end of the ventilation path including the bent part.

In the past, in recognizing a discharging amount of water vapor in the housing interior 8 of the vehicular lamp 1, the recognition was remained to the extent of referring to the size of the ventilation opening 9 based on sensory index, such as good/bad or fast/slow, by engineers. Moreover, the reference merely remained on "size of ventilation opening 9"; therefore, if a bending ventilation path leading to the ventilation opening 9 was formed, it was impossible to maintain sufficient defogging property by the former techniques.

The present inventors found that, by making the indexes of elapsed time and fogging reduction rate more appropriate, the defogging property of various types of lamps including the bending ventilation path became good. Moreover, the present inventors invented that, in various types of lamps including the bending ventilation path, a predetermined cross-sectional area was maintained to the terminal end of the bending ventilation path, and it was ascertained that the defogging property of the various types of lamps became good by actual proof.

[First Exemplary Embodiment of Ventilation Member]

Figure 2A:
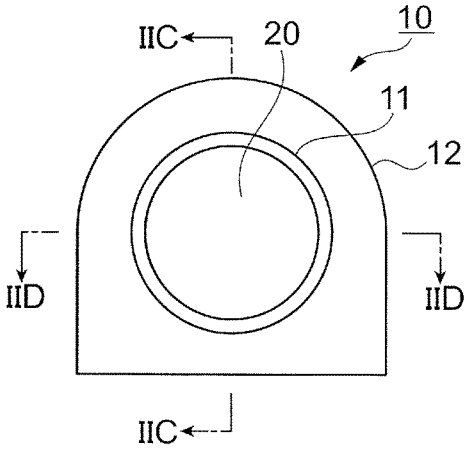
FIGS. 2A to 2E are diagrams for illustrating a ventilation member, which is a first exemplary embodiment.
Figure 2C:
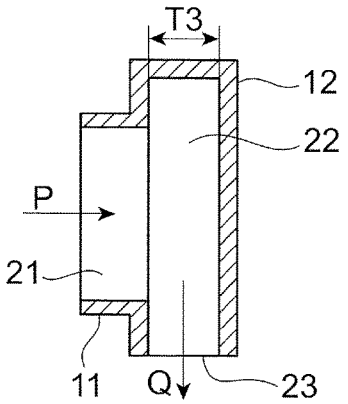
Figure 2B:
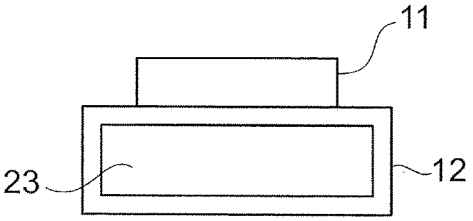
Figure 2D:
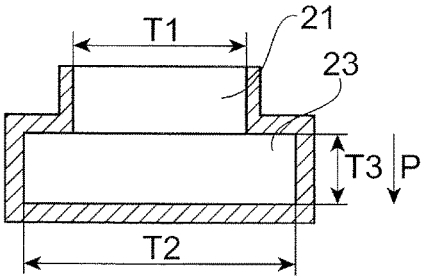
Figure 2E:
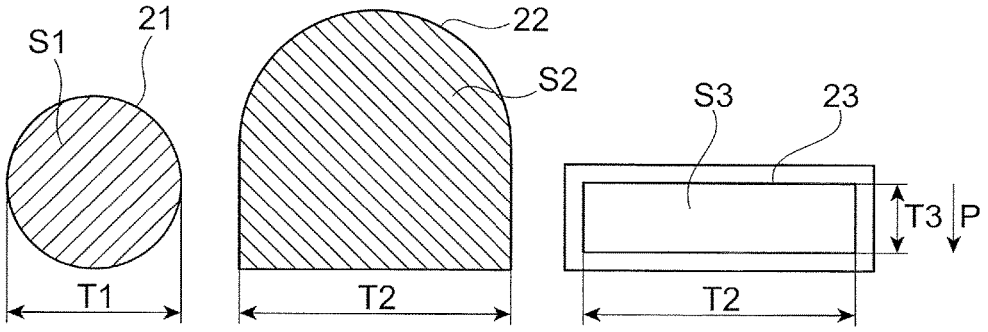

FIGS. 2A to 2E are diagrams for illustrating a ventilation member 10, which is the first exemplary embodiment. Here, FIG. 2A is an elevational view in which the ventilation member 10 is viewed from an attaching side to the ventilation opening 9 side shown in FIG. 1, and FIG. 2B is a bottom view in which the ventilation member 10 is viewed from the lower direction where a discharge port is provided. Moreover, FIG. 2C is a diagram showing a IIC-IIC cross section of the ventilation member 10 shown in FIG. 2A in the vertical direction (Q-direction) in the figure, and FIG. 2D is a diagram showing a IID-IID cross section of the ventilation member 10 shown in FIG. 2A in the horizontal direction (P-direction) in the figure. Further, FIG. 2E is a diagram for illustrating a cross-sectional area and an opening area of each location of a ventilation path 20.

The ventilation member 10 forms the ventilation path 20 configured with a void (through hole) as an inner tube, and functions as a ventilation device or a ventilation path support body. However, it is possible to define "ventilation device" to include, not only the ventilation member 10, but also the housing 2. The ventilation member 10 includes an attaching part 11 for attaching the ventilation member 10 to the ventilation opening 9 (refer to FIG. 1) and for attaching the ventilation member 10 while communicating the ventilation opening 9 and the ventilation path 20. Moreover, the ventilation member 10 includes a bent-part housing 12 that forms the bent part bending from the first direction (P-direction) to the second direction (Q-direction) in the inner tube used as the ventilation path 20. Then, the ventilation member 10 forms, by the attaching part 11 and the bent-part housing 12, the ventilation path 20 configured with an inlet-port side ventilation path 21 that is in communication with the ventilation opening 9, a bent-part inlet side 22 that follows the inlet-port side ventilation path 21 and is positioned ahead of bending constituting the bent part, the bent-part inlet side 22 having a wide-width cross section, and a bent-part outlet side 23 that follows the bent-part inlet side 22 and is positioned behind bending of the bent part.

The material of the ventilation member 10 may be a thermoplastic resin, a thermosetting resin, a metal or the like, and is not limited; however, from a standpoint of improving workability in attaching to the housing 2, it is preferable to use an elastic body, such as a thermoplastic elastomer or a thermosetting elastomer. Moreover, it is preferable to form the ventilation member 10 with a single material from a standpoint of reducing costs; however, the shape may be formed by injection molding or two-color molding using materials having different hardness. Further, the shape or attaching method of the attaching part 11 of the ventilation member 10 conforms to the structure of the ventilation opening 9 of the housing 2, but is not limited and may be a circular shape, a rectangular shape, an elliptical shape or the like.

Moreover, it is possible to apply oil repellent treatment to the ventilation member 10. As the oil repellent treatment, specific examples include formation of an oil repellent coating including a polymer having perfluoro-alkyl group. The forming methods of the ventilation member 10 include coating of solution or dispersion of a polymer having perfluoro-alkyl group by an air spray method, an electrostatic spray method, a dip coating method, a spin coating method, a roll coating method, a curtain coating method, an impregnation method or the like, or, a coating forming method by an electrodeposition coating method or a plasma polymerization method. However, the method is not particularly limited as long as a desired coating can be formed.

As shown in FIG. 2E, the cross section of the inlet-port side ventilation path 21 (the surface orthogonal to the first direction (P-direction) on the upstream side of the bent part) has a circular shape with an inner diameter T1 and has a cross-sectional area S1. Moreover, the cross section of the bent-part inlet side 22 (the surface orthogonal to the first direction (P-direction) on the bent-part inlet side) has a semi-circular shape with an inner diameter T2 and a rectangular shape with a width T2 continued to the semi-circular shape, the cross-sectional area of the cross section being S2. Further, an opening surface of the bent-part outlet side 23 (the surface orthogonal to the second direction (Q-direction) on the downstream side of the bent part) is a rectangle with a width T2 and a length T3 in the first direction, which is represented by T3×T2, and a cross-sectional area thereof is S3.

To put the above relation another way, the surface forming the cross-sectional area S2 (the cross section of the bent-part inlet side 22) of the ventilation member 10, which is the ventilation path support body, is larger than the surface forming the cross sectional area S1 (the cross section of the inlet-port side ventilation path 21), and S2 includes S1. Moreover, the cross-sectional area S2 is a cross section using a side (T2) constituting the cross-sectional area S3. The side (T2) is a length in the direction orthogonal to the first direction (P-direction), and the length thereof is longer than the length (T1) in the cross-sectional area S1 corresponding thereto. Note that the "the direction orthogonal to" means "the direction intersecting at right angles to" in the exemplary embodiment; however, if the bending is not a right angle and is bent at an obtuse angle or an acute angle, the direction is "the direction obliquely intersecting".

Here, in the exemplary embodiment, all of the cross-sectional areas S1, S2 of the ventilation path 20 and the area S3 of the opening is 300 $mm^2$ or more. In other words, the ventilation member 10 forms the ventilation path 20 that is in communication with the ventilation opening 9 and is bent, and is configured to maintain the minimum cross-sectional area of at least 300 $mm^2$ or more to the terminal end of the ventilation path including the bent part. The significance of the cross-sectional area of 300 $mm^2$ or more will be described later.

Then, in the exemplary embodiment, for smooth movement of the water vapor and quickly discharging thereof to the outside, "the opening area of the ventilation path 20 of the ventilation member 10 connected to the outside of the lamp" is made "not less than the area of the ventilation opening 9 provided on the housing 2 side (the lamp housing side) as a function of discharging the water vapor to the outside and a function of eliminating pressure difference caused by the temperature change"; accordingly, the water vapor moves smoothly and is able to be discharged to the outside in a moment. The relations between respective opening areas are as follows.

cross-sectional area S1<cross-sectional area S2 cross-sectional area S1≤cross-sectional area S3

In the exemplary embodiment, a through hole is employed as the ventilation path 20 formed in the ventilation member 10; however, the ventilation path 20 is not limited to the through hole. Even though the ventilation path 20 is a through hole, a bent ventilation path 20 is formed, and thereby it is possible to make water or dust from the outside harder to enter. Moreover, by setting the cross-sectional area S2 larger than the cross-sectional area S1, it is possible to make T2 large; accordingly, in the cross-sectional area S3 determined by T2×T3, T3 can be smaller than T1, to thereby make it possible to reduce the protruding amount of the ventilation member 10 in the P-direction.

In other words, to maintain smooth movement of the water vapor, the ventilation path 20 is required to maintain the opening area of a certain level or more to the terminal end; however, if the ventilation path 20 is bent while the ventilation path 20 remains to have the cross-sectional area S1 (if the cross section constituting the cross-sectional area S1 is rotated 90°), protrusion in the first direction (P-direction) becomes the length in the second direction of the cross-sectional area S1 (in other words, the protrusion in the first direction (P-direction) becomes the length T1), and thereby, the protruding amount becomes large. Particularly, in recent years, further improvement of the defogging property of a lamp has been required, and as a result, the area of the ventilation opening 9 was increased, and it was also necessary to increase the opening area of the ventilation path 20 of the ventilation member 10. On the other hand, downsizing of the device has been strongly required. Then, in the exemplary embodiment, the wide-width T2 was employed in the bent part; therefore, as the protrusion of the bent part in the P-direction, even if T3, which was the length smaller than the length of the cross-sectional area S1 in the second direction or the length in the case where the cross section constituting the cross-sectional area S1 was rotated 90°, was employed, it was possible to maintain the opening cross section of a certain level or more (for example, 300 $mm^2$ or more), and thereby, it became possible to provide the ventilation member 10 that is thin in the P-direction while maintaining smooth movement of the water vapor.

Note that, as shown in FIG. 1, when the ventilation member 10 is fitted over the protruding part 2*a*, whether or not the thickness of the housing 2 is taken into consideration or not causes a problem; however, if the thickness is sufficiently small, there is no need for particular consideration. However, if the thickness is large and the ventilation member 10 is fitted over from the outside of the protruding part 2*a*, the cross-sectional area of the ventilation path 20 is reduced only at the part. In such a case, regarding the cross-sectional area of the ventilation member 10, it is necessary to take the thickness into consideration and discuss the size of the inner diameter with the exception of the thickness. However, since description will be complicated, these considerations are summed up in the present specification, and description is given by assuming the inner diameter T1 in the cross-sectional area S1.

[Second Exemplary Embodiment of Ventilation Member]

Next, a second exemplary embodiment of the ventilation member will be described.

Figure 3A:
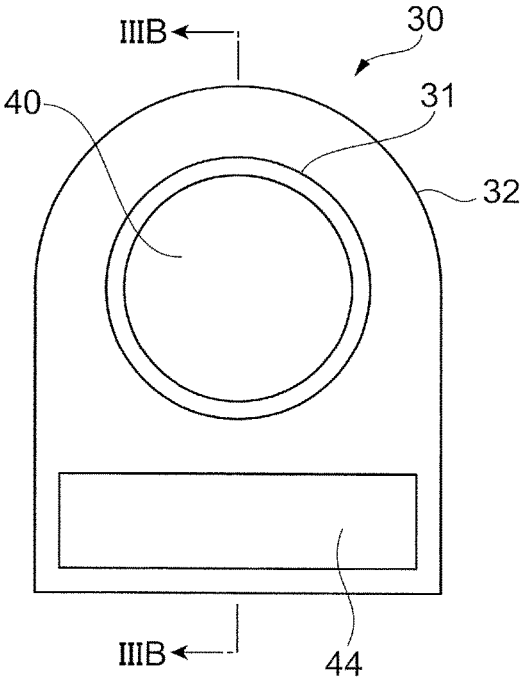
FIGS. 3A and 3B are diagrams for illustrating a ventilation member, which is a second exemplary embodiment.
Figure 3B:
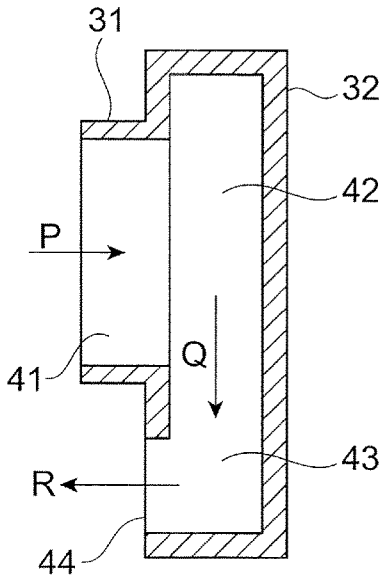

FIGS. 3A and 3B are diagrams for illustrating a ventilation member 30, which is the second exemplary embodiment. Here, FIG. 3A is an elevational view in which the ventilation member 30 is viewed from an attaching side to the ventilation opening 9 side shown in FIG. 1, and FIG. 3B is a diagram showing a IIIB-IIIB cross section in the vertical direction (Q-direction) in the figure in the ventilation member 30 shown in FIG. 3A. Note that description of functions, materials, treatments or the like similar to those of the first exemplary embodiment is omitted here.

The ventilation member 30 includes an attaching part 31 for attaching the ventilation member 30 to the ventilation opening 9 and for communicating the ventilation opening 9 with the ventilation path 40. Moreover, the ventilation member 30 includes a bent-part housing 32 that forms the bent part bending from the first direction (P-direction) to the second direction (Q-direction) in the inner tube used as the ventilation path 40. In the second exemplary embodiment, characteristics are present in further bending from the second direction (Q-direction) to a third direction (R-direction), and the bending to the third direction (R-direction) is also formed by the bent part housing 32.

The ventilation member 30 forms, by the attaching part 31 and the bent-part housing 32, the ventilation path 40 configured with an inlet-port side ventilation path 41 that is in communication with the ventilation opening 9 shown in FIG. 1, a bent-part inlet side 42 that is positioned ahead of bending constituting the bent part and has a wide-width cross section following the inlet-port side ventilation path 41, a bent-part outlet side 43 that follows the bent-part inlet side 42 and is positioned behind bending of the bent part, and a discharge port 44 further bending toward the R-direction.

The cross sections of respective locations of the ventilation path 40 are similar to those of the first exemplary embodiment shown in FIG. 2E, and therefore, illustration thereof is omitted here. The cross section of the inlet-port side ventilation path 41 (the surface orthogonal to the first direction (P-direction) on the upstream side of the bent part) has, similar to the inlet-port side ventilation path 21 in the first exemplary embodiment, a circular shape with an inner diameter T1 and has a cross-sectional area S1. Moreover, the cross section of the bent-part inlet side 42 (the surface orthogonal to the first direction (P-direction) on the bent-part inlet side) forming the bent part has a semi-circular shape with an inner diameter T2 and a rectangular shape with a width T2 continued to the semi-circular shape, which are similar to the bent-part inlet side 22 of the first exemplary embodiment, the cross-sectional area of the cross section being S2'. This S2' is different from the cross-sectional area S2 shown in FIG. 2E only in the shape of the rectangle added as a cross section, and therefore, hereinafter, S2 will be described as S2. Further, similar to the opening surface of the bent-part outlet side 23 in the first exemplary embodiment, an opening surface of the bent-part outlet side 43 (the surface orthogonal to the second direction (Q-direction) on the downstream side of the bent part) is a rectangle with a width T2 and a length T3 in the first direction, and a cross-sectional area thereof is S3. Then, the area of the discharge port 44 is S3, which is similar to the area of the opening in the bent-part outlet side 43. Note that it is also preferable to make the discharge port 44 larger than the cross-sectional area of the opening in the bent-part outlet side 43.

Then, in the exemplary embodiment, similar to the first exemplary embodiment, all of the cross-sectional areas S1, S2, S3 of the ventilation path 40 and the area S3 of the opening in the discharge port is 300 $mm^2$ or more. In other words, the ventilation member 30 forms the ventilation path 40 that is in communication with the ventilation opening 9 and is bent, and is configured to maintain the minimum cross-sectional area of at least 300 $mm^2$ or more to the terminal end of the ventilation path 40 including the bent part. Further, relations between the opening areas (cross-sectional area S1<cross-sectional area S2, cross-sectional area S1≤cross-sectional area S3) are similar to those in the first exemplary embodiment. The ventilation path 40 being a through hole is also similar to the first exemplary embodiment.

As described above, in the second exemplary embodiment, the ventilation member 30, which is the ventilation path support body, includes the ventilation path 40 further bending from the second direction (Q-direction) toward the third direction (R-direction). This can reduce infiltration of water or dust from the outside more successfully. Moreover, since the cross section of 300 $mm^2$ or more is maintained, even if the bending locations are increased, it becomes possible to provide the ventilation member 30 that is thin in the P-direction, which is related to the thickness from the attaching part, while maintaining smooth movement of the water vapor from the housing 2 side of the lamp. Further, since the direction of the discharge port 44 can be selected relatively freely, it becomes possible to select the orientation of the ventilation path 40 or the like; accordingly, degree of freedom in designing the vehicular lamp 1 as a whole can be increased.

[Third Exemplary Embodiment of Ventilation Member]

Next, a third exemplary embodiment of the ventilation member will be described.

Figure 4A:
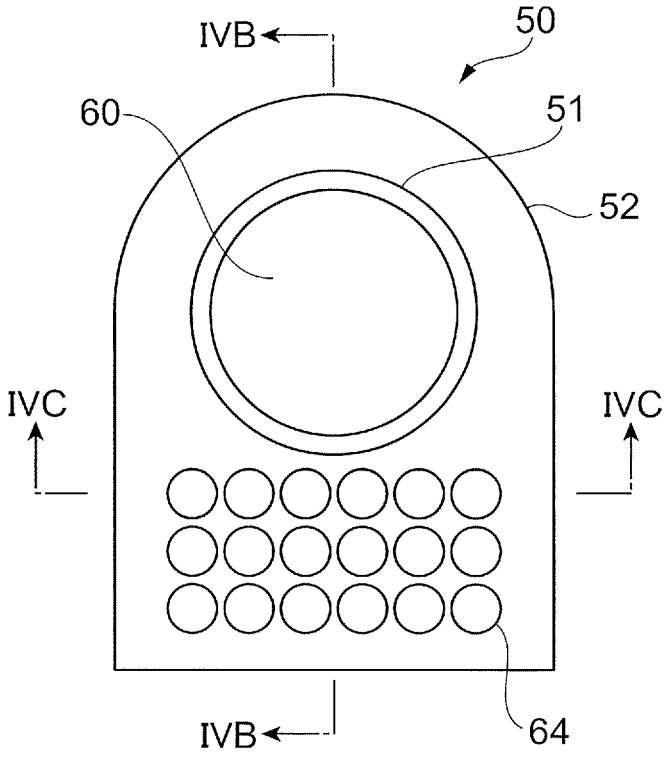
FIGS. 4A to 4C are diagrams for illustrating a ventilation member, which is a third exemplary embodiment.
Figure 4B:
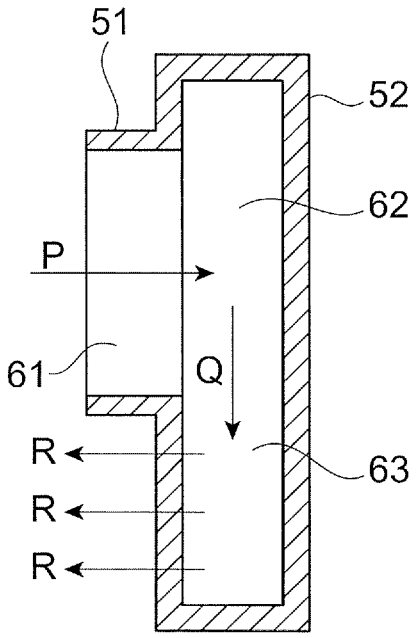
Figure 4C:
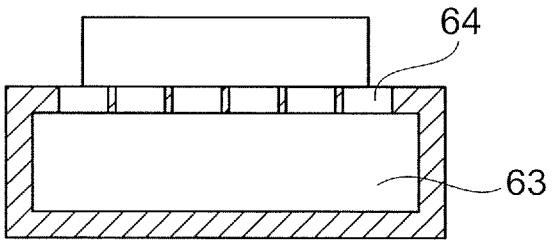

FIGS. 4A to 4C are diagrams for illustrating a ventilation member 50, which is the third exemplary embodiment.

Here, FIG. 4A is an elevational view in which the ventilation member 50 is viewed from an attaching side to the ventilation opening 9 side shown in FIG. 1, and FIG. 4B is a diagram showing a IVB-IVB cross section in the vertical direction (Q-direction) in the figure in the ventilation member 50 shown in FIG. 4A. FIG. 4C is a diagram showing a IVC-IVC cross section of the ventilation member 50 shown in FIG. 4A in the horizontal direction (P-direction) in the figure.

The third exemplary embodiment shown in FIGS. 4A to 4C has characteristics in that the discharge port 44 of the second exemplary embodiment shown in FIGS. 3A and 3B is configured with plural discharge ports. Note that description of matters similar to those of the first exemplary embodiment and the second exemplary embodiment is omitted here.

The ventilation member 50 includes an attaching part 51 for attaching the ventilation member 50 to the ventilation opening 9 and for communicating the ventilation opening 9 with the ventilation path 60. Moreover, the ventilation member 50 includes a bent-part housing 52 that forms the bent part bending from the first direction (P-direction) to the second direction (Q-direction) in the inner tube used as the ventilation path 60. In the third exemplary embodiment, similar to the second exemplary embodiment, the ventilation path 60 is further bent from the second direction (Q-direction) toward the third direction (R-direction). The ventilation member 50 forms, by the attaching part 51 and the bent-part housing 52, the ventilation path 60 configured with an inlet-port side ventilation path 61 that is in communication with the ventilation opening 9 shown in FIG. 1, a bent-part inlet side 62 that follows the inlet-port side ventilation path 61 to be positioned ahead of bending constituting the bent part and has a wide-width cross section, a bent-part outlet side 63 that follows the bent-part inlet side 62 and is positioned behind bending of the bent part, and a discharge port 64 further bending toward the R-direction. The discharge port 64 is configured with plural openings. The specific example shown in FIG. 4A includes 18 openings as a whole. However, the number of openings is not limited to that of the exemplary embodiment. Moreover, regarding the orientations of the openings, there is no need for all of the openings to face the third direction (R-direction), and part of the openings may be configured to face the second direction (Q-direction).

The cross sections of respective locations of the ventilation path 60 are similar to those of the first and second exemplary embodiments shown in FIG. 2E, and therefore, illustration thereof is omitted here. The cross section of the inlet-port side ventilation path 61 (the surface orthogonal to the first direction (P-direction) on the upstream side of the bent part) has, similar to the inlet-port side ventilation path 21 in the first exemplary embodiment, a circular shape with an inner diameter T1 and has a cross-sectional area S1. Moreover, the cross section of the bent-part inlet side 42 (the surface orthogonal to the first direction (P-direction) on the bent-part inlet side) has a semi-circular shape with an inner diameter T2 and a rectangular shape with a width T2 continued to the semi-circular shape, which are similar to the bent-part inlet side 22 of the first exemplary embodiment, the cross-sectional area of the cross section being S2". This S2" is different from the cross-sectional area S2 shown in FIG. 2E and S2' in the second exemplary embodiment only in the shape of the rectangle added as a cross section, and therefore, hereinafter, S2" will be described as S2. Further, similar to the opening surface of the bent-part outlet side (23, 43) in the first and second exemplary embodiments, an opening surface of the bent-part outlet side 63 (the surface orthogonal to the second direction (Q-direction) on the downstream side of the bent part) is a rectangle with a width T2 and a length T3 in the first direction, and a cross-sectional area thereof is S3. Then, by summing all of the areas of the 18 opening holes, the area of the discharge port 64 is S3, which is similar to the area of the opening in the bent-part outlet side 63. Note that it is also preferable to make the discharge port 64, which is the sum of the areas of plural opening holes, larger than the cross-sectional area of the opening in the bent-part outlet side 63.

Then, in the exemplary embodiment, similar to the first and second exemplary embodiments, all of the cross-sectional areas S1, S2, S3 of the ventilation path 60 is 300 $mm^2$ or more. In other words, the ventilation member 50 forms the ventilation path 60 that is in communication with the ventilation opening 9 and is bent, and is configured to maintain the minimum cross-sectional area of at least 300 $mm^2$ or more to the terminal end of the ventilation path 60 including the bent part. Further, relations between the opening areas (cross-sectional area S1<cross-sectional area S2, cross-sectional area S1≤cross-sectional area S3) are similar to those in the first and second exemplary embodiments. The ventilation path 60 being a through hole is also similar to the first and second exemplary embodiments.

In this manner, in the third exemplary embodiment, the plural opening holes were configured as the discharge port 64. Then, the sum of the hole areas of the opening holes is 300 $mm^2$ or more. A multiple number of opening holes may be provided to any locations in the course of the ventilation path. Though each of the opening holes is small, 300 mm2 or more can be ensured by summing thereof; for example, even if opening holes responding to a design request are used, it is possible to highly maintain the defogging property.

[Fourth Exemplary Embodiment of Ventilation Member]

Next, a fourth exemplary embodiment of the ventilation member will be described.

Figure 5A:
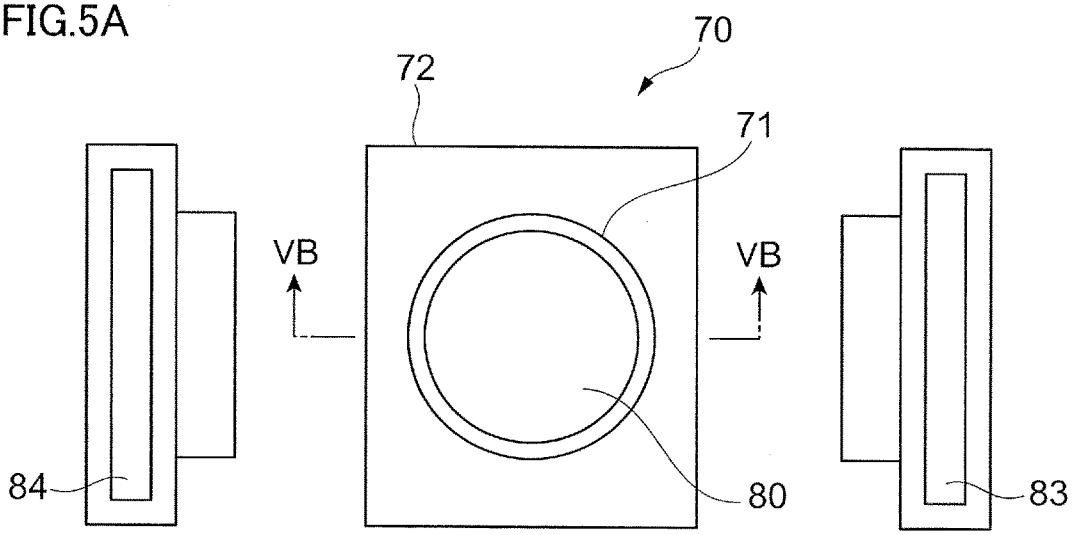
FIGS. 5A to 5C are diagrams for illustrating a ventilation member, which is a fourth exemplary embodiment.
Figure 5B:
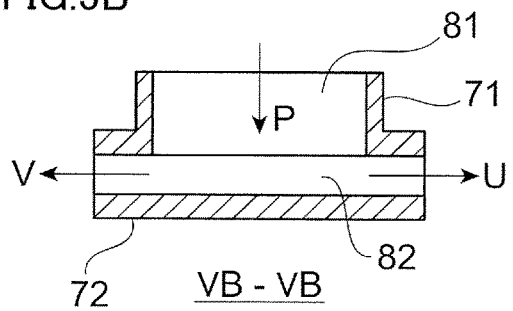
Figure 5C:
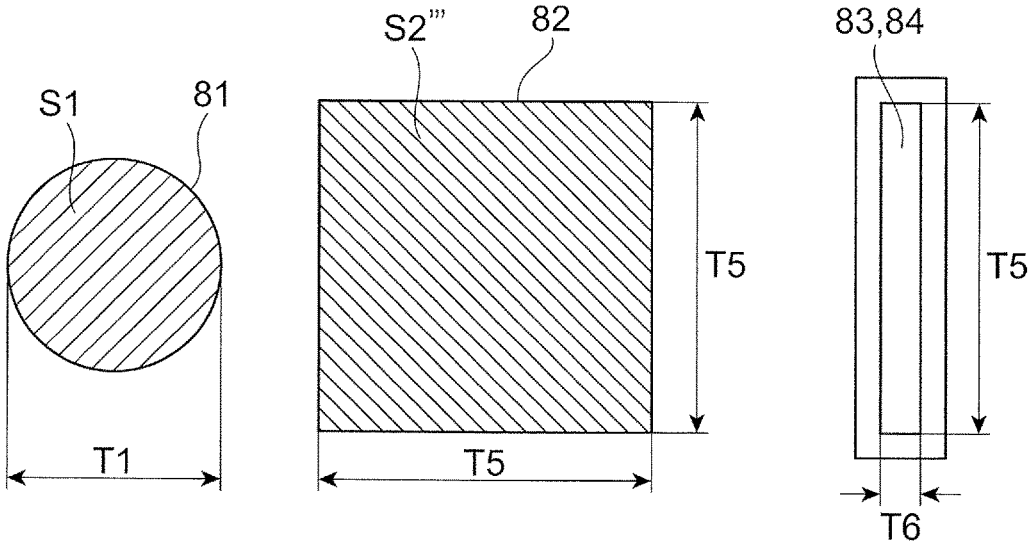

FIGS. 5A to 5C are diagrams for illustrating a ventilation member 70, which is the fourth exemplary embodiment.

Here, FIG. 5A is an elevational view in which the ventilation member 70 is viewed from an attaching side to the ventilation opening 9 side shown in FIG. 1, and FIG. 5B is a diagram showing a VB-VB cross section of the ventilation member 70 shown in FIG. 5A. Moreover, FIG. 5C is a diagram for illustrating a cross section of each location constituting the ventilation path 80.

The fourth exemplary embodiment shown in FIGS. 5A to 5C includes characteristics in that final discharge ports when the water vapor is discharged are provided in many directions, and the ventilation path 80 is bent in plural directions to be branched. Note that description of matters similar to those of the first to third exemplary embodiments is omitted here.

The ventilation member 70 includes an attaching part 71 for attaching the ventilation member 70 to the ventilation opening 9 and for communicating the ventilation opening 9 with the ventilation path 80. Moreover, the ventilation member 70 includes a bent-part housing 72 that forms the bent part bending from the first direction (P-direction) to plural directions (in FIG. 5B, two directions of V-direction and U-direction) in the inner tube used as the ventilation path 80. The ventilation member 70 forms, by the attaching part 71 and the bent-part housing 72, the ventilation path 80 configured with an inlet-port side ventilation path 81 that is in communication with the ventilation opening 9 shown in FIG. 1, a bent-part inlet side 82 that follows the inlet-port side ventilation path 81 to be positioned ahead of bending constituting the bent part and has a wide-width cross section, and two discharge ports (a first discharge port 83, a second discharge port 84) that follow the bent-part inlet side 82 and is positioned behind bending of the bent part. Note that the discharge ports may be increased further, to thereby provide a third and a fourth discharge ports.

As shown in FIG. 5C, the cross section of the inlet-port side ventilation path 81 (the surface orthogonal to the first direction (P-direction) on the upstream side of the bent part) has, similar to the inlet-port side ventilation path 21 in the first exemplary embodiment, a circular shape with an inner diameter T1 and has a cross-sectional area S1. Moreover, the cross section of the bent-part inlet side 82 (the surface orthogonal to the first direction (P-direction) on the bent-part inlet side) has a square shape with a side T5, which is longer than T1, the cross-sectional area of the cross section being S2'''. Hereinafter, for convenience of description, this S2''' will be described as S2. Further, the opening surfaces corresponding to the outlet side of the bent part are surfaces orthogonal to the U-direction and the V-direction on the downstream side of the bent part, namely, the first discharge port 83 and the second discharge port 84, each of which is T5×T6 individually. By summing thereof and doubling here, the total cross-sectional area, which is summed cross-sectional areas, is S3. Note that, to simplifying the description, the same sign as "S3" used in the first to third exemplary embodiments is also used here. Since the length T6 related to the thickness in the depth direction (P-direction) can ensure a sufficient cross section due to the plural discharge ports, and therefore, it is possible to make individual T6 short, as 10 mm or less.

Then, in the exemplary embodiment, similar to the first to third exemplary embodiments, all of the cross-sectional areas S1, S2, and the total cross-sectional area S3 of the ventilation path 80 is 300 $mm^3$ or more. In other words, the ventilation member 70 forms the ventilation path that is in communication with the ventilation opening 9 and is bent, and is configured to maintain the minimum cross-sectional area of at least 300 $mm^2$ or more to the terminal end of the ventilation path including the bent part. Further, relations between the opening areas (cross-sectional area S1<cross-sectional area S2, cross-sectional area S1≤cross-sectional area S3) are similar to those in the first to third exemplary embodiments. The ventilation path 80 being a through hole is also similar to the first to third exemplary embodiments.

In this manner, in the fourth exemplary embodiment, the plural opening holes were configured by providing the first discharge port 83 and the second discharge port 84 as the plural discharge ports. Then, the sum of the hole areas of the plural opening holes is 300 $mm^2$ or more. In this manner, by forming the discharge port at the terminal end by use of one side (here, T5) of the bent-part inlet side 82 forming the bent part of the ventilation member 70, and further, by providing the plural discharge ports, even if the length in the depth direction (first direction, P-direction) is made shorter than the length in the first direction when the cross section constituting the cross-sectional area S1 is rotated 90°, it becomes possible to maintain good defogging property.

EXAMPLES

Subsequently, the ventilation member 10 (30, 50, 70) according to the present invention will be described in more detail by use of examples. Note that the present invention is not limited to the following examples.

Example 1

After humidity control and water injection are performed as described below to the vehicular lamp 1 including the ventilation opening 9, the ventilation member 10 was attached to the ventilation opening 9, and then fogging reduction rate was measured.

In this example, as the ventilation member 10, a ventilation member 10 in a tubular shape including the bent part, with the inner diameter of 40 mm and the cross-sectional area of the ventilation path 20 of 1257 $mm^2$ was used. In other words, the ventilation member 10 used in this example has the cross-sectional area of 1257 $mm^2$ from one end of the ventilation path to the other end of the ventilation path including the bent part.

Moreover, as the vehicular lamp 1, a head lamp for a medium-sized vehicle with an internal volume of 6900 cc (HL of a 2011 model Genesis Coupé manufactured by Hyundai Mobis Ltd.) was used.

(Humidity Control)

The vehicular lamp 1 including the ventilation opening 9 was left in a hot-dry condition (temperature: 80±2° C., relative humidity (RH): 10%) for 2 hours. Subsequently, while the ventilation opening 9 and the like were left open (without attaching the ventilation member 10), the vehicular lamp 1 was left in an ordinary temperature and pressure condition (temperature: 15° C. to 35° C., RH: 45% to 75%) for 1 hour. Thereafter, while the ventilation opening 9 was left open, the vehicular lamp 1 was left in a humidity control condition (temperature: 38° C., RH: 70%) for 1 hour, to thereby control the humidity in the housing interior 8 of the vehicular lamp 1.

(Water Injection)

To the ventilation opening 9 of the vehicular lamp 1 immediately after the above-described humidity control was performed thereon, the ventilation member 10 was attached. Then, after lighting for 20 minutes, the vehicular lamp 1 was turned off.

Thereafter, by use of a hose with an internal diameter of 19 mm, water injection to the vehicular lamp 1 in a turn-off state was conducted from the front side of the lens 3 for 3 minutes. Note that water of 10±2° C. water temperature was used while setting the water pressure at 100±20 kPa. Moreover, water injection was conducted while the tip of the hose was in a state being separated 10 cm from the lens 3 of the vehicular lamp 1 and water injection angle was changed from the vertical direction (90° upward with respect to the horizontal direction) to 30° upward with respect to the horizontal direction.

(Measurement of Fogging Reduction Rate)

Subsequently, after lighting the vehicular lamp 1 for 10 minutes, the state of the lens 3 was observed until being defogged while the vehicular lamp 1 remained lighted, and thereby the fogging reduction rate of the lens 3 was measured.

Note that, in this example, "fogging reduction rate (%)" represents an elimination amount of the fog of the lens 3 after the elapse of a predetermined time after lighting the vehicular lamp 1 for 10 minutes. In this case, the fogging state of the lens 3 at the point of time when the vehicular lamp 1 has been lighted for 10 minutes (elapsed time is 0 minute) is assumed to be the fogging reduction rate of 0%. For example, the fogging reduction rate of 50% refers to the state in which the fog of the lens 3 is eliminated by half as compared to the state at the point of time when the vehicular lamp 1 has been lighted for 10 minutes (elapsed time is 0 minute). Moreover, the fogging reduction rate of 100% indicates the state in which all the fog of the lens 3 is eliminated (the state in which the fog does not occur on the lens 3 at all).

Usually, in the lamp, such as the vehicular lamp 1, it is possible to use the lamp without any concern for influence of the fog of the lens 3 if the fogging reduction rate is 80% or more.

In this example, the fogging reduction rate was visually measured by observing the lens 3 of the vehicular lamp 1 from the front side (from the outside of the vehicular lamp 1) at predetermined time intervals.

Note that, other than the measurement by visual observation, the fogging reduction rate may be calculated by, for example, photographing the lens 3 at predetermined time intervals and applying image processing on the photographed image.

Examples 2, 3 and Comparative Examples 1, 2

Other than changing the inner diameter of the ventilation member 10 to be attached to the ventilation opening 9 of the vehicular lamp 1 and the cross-sectional area of the ventilation path, measurement of the fogging reduction rate of the lens 3 in the vehicular lamp 1 was conducted in a similar manner as Example 1.

Here, in Example 2, a ventilation member 10 in a tubular shape with the inner diameter of 30 mm and the cross-sectional area of 707 $mm^2$ was used, and, in Example 3, a ventilation member 10 in a tubular shape with the inner diameter of 20 mm and the cross-sectional area of 314 $mm^2$ was used. Moreover, in Comparative example 1, a ventilation member 10 in a tubular shape with the inner diameter of 15 mm and the cross-sectional area of 177 $mm^2$ was used, and, in Comparative example 2, a ventilation member 10 in a tubular shape with the inner diameter of 10 mm and the cross-sectional area of 79 $mm^2$ was used.

Comparative Example 3

Other than providing three ventilation openings 9 to the vehicular lamp 1 and changing the ventilation member 10 to be attached to each ventilation opening 9, measurement of the fogging reduction rate of the lens 3 in the vehicular lamp 1 was conducted in a similar manner as Example 1.

As each ventilation member 10 to be attached to the ventilation opening 9, a rubber ventilation member 10 in a tubular shape with the inner diameter of 8.5 mm and the cross-sectional area of 57 $mm^2$ was used, the ventilation member 10 including a bent part and a ventilation path filled with a porous sponge. Note that, in Comparative example 3, the sum of the cross-sectional areas of the three ventilation members 10 is 171 $mm^2$.

[Evaluation of Fogging Reduction Rate]

Figure 6:
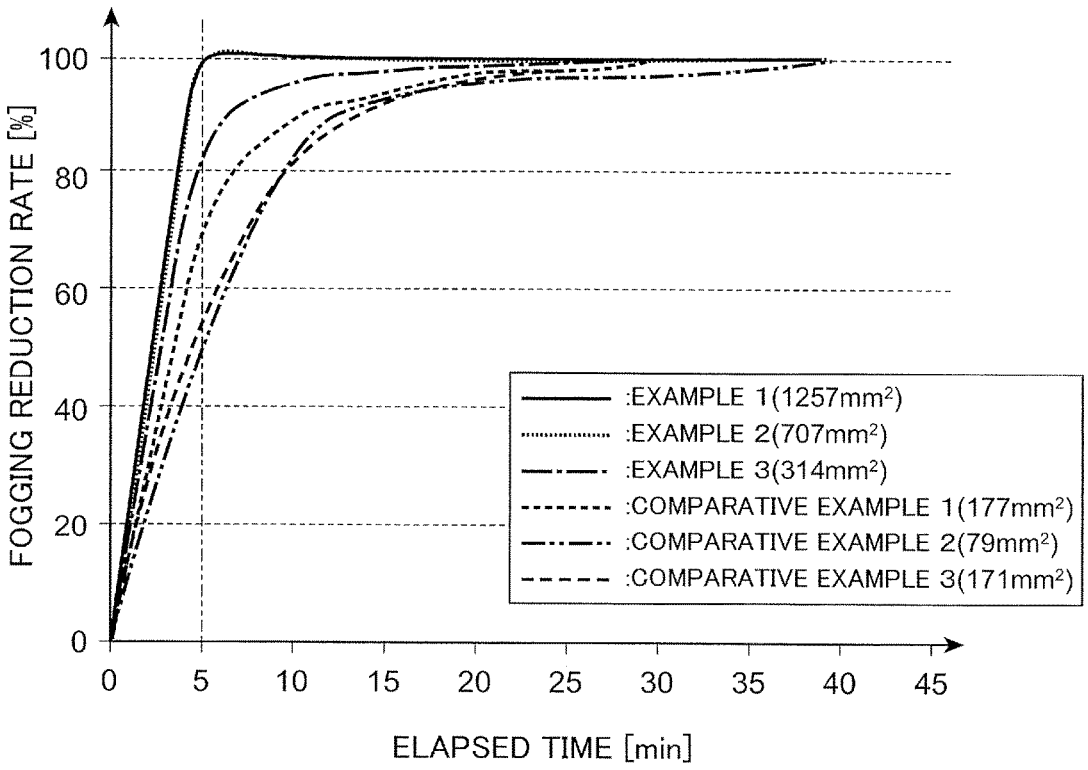
FIG. 6 is a diagram showing measurement results of fogging reduction rates in Examples 1 to 3 and Comparative examples 1 to 3.

FIG. 6 is a diagram showing measurement results of fogging reduction rates in Examples 1 to 3 and Comparative examples 1 to 3, and more specifically, a diagram showing changes over time in the fogging reduction rate measured in Examples 1 to 3 and Comparative examples 1 to 3.

As shown in FIG. 6, in Examples 1 to 3, the fogging reduction rate of the lens 3 is 80% or more within 5 minutes of elapsed time.

In other words, in the vehicular lamp 1 using the ventilation member 10 of Examples 1 to 3, it was confirmed that, even if fogging occurred on the lens 3, fogging was able to be eliminated to the extent that no influence was exerted on use in a short time, such as within 5 minutes.

In contrast thereto, in Comparative examples 1 to 3, it took more than 5 minutes to obtain the fogging reduction rate of lens 3 of 80% or more; therefore, it was confirmed that a longer time was needed to eliminate the fogging of the lens 3 as compared to Examples 1 to 3.

The elapsed time of 5 minutes is the time derived by the inventor and the like as a criterion about occurrence of trouble as a lamp used for a vehicle.

Moreover, from another standpoint, as shown in FIG. 6, in Examples 1 to 3, an increasing rate of the fogging reduction rate (namely, the slope of the graph shown in FIG. 6) in an early stage of elapsed time is significantly large as compared to Comparative examples 1 to 3.

In other words, it was confirmed that, by configuring the ventilation member 10 to maintain the minimum cross-sectional area of at least 300 $mm^2$ or more to the terminal end of including the bent part, the fogging of the lens 3 was able to be quickly eliminated as compared to the case where the minimum cross-sectional area of the ventilation path was less than 300 $mm^2$.

Subsequently, when Examples 1 to 3 were compared with one another, it was confirmed that, in Examples 1 and 2, the fogging reduction rate was able to be 80% or more in a shorter time as compared to Example 3. Moreover, when Examples 1 and 2 were compared with each other, despite the larger cross-sectional area of the ventilation path 20 in Example 1 as compared to Example 2, there was little difference in the fogging reduction rate.

Consequently, for obtaining good defogging property while suppressing infiltration of foreign substances into the housing interior 8 of the vehicular lamp 1 via the ventilation member 10 and suppressing upsizing of the ventilation member 10, it was confirmed that the minimum cross-sectional area of the ventilation member 10 was preferably of the order of 700 $mm^2$.

Moreover, though illustration is omitted, when humidity control and water injection were performed and the vehicular lamp 1 was lighted for 10 minutes in a similar manner as Example 1, except for using the ventilation member 10 with the inner diameter of 60 mm and the cross-sectional area of 2826 $mm^2$, it was confirmed that the fogging did not occur on the lens 3 (the fogging reduction rate is 100% in the elapsed time of 0 minute).

Note that, in the above-described Examples 1 to 3, the ventilation member 10 in a tubular shape including the bent part was used. However, as long as the ventilation member 10 includes the bent part and the minimum cross-sectional area of the ventilation path 20 (if the ventilation path is branched, the sum of the minimum cross-sectional areas of the plural ventilation paths) is at least 300 $mm^2$ or more, regardless of the shape thereof, for example, even with the shape of the ventilation member 30, 50 or 70 shown in FIGS. 3A and 3B to FIGS. 5A to 5C, needless to say, the same result as those shown in FIG. 6 can be obtained.

As described in detail above, according to the exemplary embodiments, by making the indexes of elapsed time and fogging reduction rate appropriate, it was possible to obtain good defogging property of various types of lamps including the bending ventilation path (20, 40, 60, 80). Particularly, in the exemplary embodiments, as the index of the elapsed time and the fogging reduction rate, the fogging reduction rate of 80% or more within the elapse time of 5 minutes is adopted. Then, by keeping the minimum cross-sectional area capable of maintaining the index to the terminal end of the ventilation path (20, 40, 60, 80) including the bent part, even in the case where the bending ventilation path (20, 40, 60, 80) is formed as described above, excellent defogging property can be achieved.

Moreover, in the exemplary embodiments, in various types of lamps including the bending ventilation path (20, 40, 60, 80), a predetermined cross-sectional area is maintained to the terminal end of the bending ventilation path (20, 40, 60, 80), and thereby, the good defogging property of the vehicular lamp 1 is provided. Particularly, in the exemplary embodiments, as the predetermined cross-sectional area, the minimum cross-sectional area of 300 $mm^2$ or more is maintained to the terminal end of the ventilation path (20, 40, 60, 80) including the bent part. Particularly, in recent years, improvement in quality of various kinds of lamps is called for and further improvement of the defogging property is demanded; if the improvements are to be achieved by the hollow ventilation member, there is significance in that the cross-sectional area of the opening is 300 $mm^2$ or more.

While the cross-sectional area of the opening is extended, it is required to bend the hollow ventilation member for ensuring the dust-proofing and waterproofing property. The tubular structure configured with the circular cross section of 300 $mm^2$ or more has a diameter of about 20 mm; if the tubular structure is directly bent, protrusion by the bent part alone becomes larger than 20 mm. On the depth side of the vehicular lamp 1, for example, an engine room or the like exists and various kinds of appliances, such as an electronic control unit (ECU), and the like are gathered, and accordingly, it is not preferable that the tubular structure is directly protruded because of space problems. According to the exemplary embodiments, it becomes possible to bend the ventilation path (20, 40, 60, 80) at a narrow portion thereof while maintaining a sufficient cross-sectional area throughout the ventilation path.

REFERENCE SIGNS LIST

1 Vehicular lamp
2 Housing
3 Lens
8 Housing interior
9 Ventilation opening
10, 30, 50, 70 Ventilation member
20, 40, 60, 80 Ventilation path

The invention claimed is:

1. A ventilation device for discharging water vapor in an interior of a housing of a vehicular lamp to an outside of the housing, the ventilation device comprising:

a ventilation path support body that forms a ventilation path that is bent and is in communication with a ventilation opening in the housing, the ventilation path support body being configured to allow the ventilation path to maintain, up to a terminal end of the ventilation path including a bent part, a minimum cross-sectional area that maintains a fogging reduction rate of 80% or more in a lapse of 5 minutes.

2. The ventilation device according to claim 1, wherein the minimum cross-sectional area of the ventilation path is at least 300 $mm^2$ or more, and the minimum cross-sectional area of at least 300 $mm^2$ or more is maintained up to the terminal end.

3. The ventilation device according to claim 2, wherein the ventilation path of the ventilation path support body has the bent part bending from a first direction to a second direction, and a protruding amount toward the first direction at the bent part is smaller than an opening width of the ventilation opening while maintaining the sum of the cross-sectional area of the ventilation path of 300 $mm^2$ or more.

4. A ventilation device for discharging water vapor in an interior of a housing of a vehicular lamp to an outside of the housing, the ventilation device comprising:

a ventilation path support body that forms a ventilation path that is bent and is in communication with a ventilation opening in the housing, the ventilation path support body being configured to allow the ventilation path to maintain, up to a terminal end of the ventilation path including a bent part, a minimum cross-sectional area of at least 300 $mm^2$ or more.

5. The ventilation device according to claim 4, wherein the ventilation path of the ventilation path support body includes a branch part from which a plurality of ventilation paths are branched off, and a sum of minimum cross-sectional areas of the plurality of paths after branching is 300 $mm^2$ or more, the ventilation path being configured to maintain the sum of the minimum cross-sectional areas of 300 $mm^2$ or more from the branch part up to the terminal end of the ventilation path.

6. A vehicular lamp comprising:

an electrical component that emits light;

a housing that forms a space inside thereof including the electrical component;

a ventilation opening provided to the housing to discharge water vapor in an interior of the housing; and a ventilation path support body that forms a ventilation path that is bent and is in communication with the ventilation opening in the housing, wherein the ventilation path of the ventilation path support body is configured to maintain, up to a terminal end of the ventilation path including a bent part, a minimum cross-sectional area that maintains a fogging reduction rate of 80% or more in a lapse of 5minutes, or is configured to maintain, up to the terminal end of the ventilation path including the bent part, a minimum cross-sectional area of at least 300 $mm^2$ or more.

* * * * *